United States Patent [19]

Guess

[11] Patent Number: 4,674,575

[45] Date of Patent: Jun. 23, 1987

[54] SEALING SYSTEM FOR DOWNHOLE WELL VALVES

[75] Inventor: Edward L. Guess, Tulsa, Okla.

[73] Assignee: Baker Oil Tools, Inc., Orange, Calif.

[21] Appl. No.: 850,714

[22] Filed: Apr. 11, 1986

[51] Int. Cl.[4] ..... E21B 34/06

[52] U.S. Cl. ..... 166/332; 137/516.29; 166/334; 251/332; 251/359

[58] Field of Search ..... 251/210, 298, 332, 359, 251/362-365, 368; 137/516.29, 516.27; 166/316, 319, 321, 325, 326, 332, 373, 386, 334

[56] References Cited

U.S. PATENT DOCUMENTS

| | | | |
|---|---|---|---|
| 2,744,539 | 5/1956 | Jones | 251/361 |
| 2,835,269 | 5/1958 | Seymour | 251/332 |
| 3,758,072 | 9/1973 | Herd | 251/332 |
| 3,809,362 | 5/1974 | Baumann | 251/332 |
| 3,986,699 | 10/1976 | Wucik, Jr. et al. | 251/210 X |
| 4,427,071 | 1/1984 | Carmody | 166/332 |
| 4,552,233 | 11/1985 | Klima | 175/371 |
| 4,583,596 | 4/1986 | Davis | 166/332 |

*Primary Examiner*—James A. Leppink
*Assistant Examiner*—Hoang C. Dang
*Attorney, Agent, or Firm*—Norvell & Associates

[57] ABSTRACT

A sealing system for a valve disposed downhole in a subterranean well and subject to a high-temperature and high-pressure environment, comprises an annular valve seat defining a primary annular metallic seating surface surrounded by a groove within which is mounted a nonresilient, nonmetallic sealing element which is spring urged to project axially beyond the end of the primary sealing surface. The valve head is provided by a primary metallic sealing surface which, as the valve head moves toward engagement with the valve seat first engages the nonresilient, nonmetallic sealing element and deflects same axially and concurrently expands it radially outwardly so that the nonmetallic, nonresilient sealing element ends up engaging a cylindrical surface surrounding the primary sealing surface formed on the valve head.

5 Claims, 3 Drawing Figures

SEALING SYSTEM FOR DOWNHOLE WELL VALVES

BACKGROUND OF THE INVENTION

1. Field of the Invention

This invention relates to an improved sealing system for a valve which is employed downhole in a subterranean well in a high-temperature, high-pressure environment.

2. History of the Prior Art

It is the common practice in subterranean wells to incorporate one or more safety valves; for example, a flapper or a ball valve, in the lower regions of the wall, generally above the production zone of the well. In such location, the sealing elements of the valve are exposed to both a high-pressure and a high-temperature environment. The high presssure produces severe erosion of metallic sealing surfaces when they are cracked open, or just prior to effecting a complete closing, due to the erosion effects of particulates, such as sand, carried at high velocity past the sealing surfaces. The high-temperature environment encountered in modern wells of substantial depth prohibits the use of an elastomeric material as the primary sealing element, and forces reliance on employment of mutually engaging metallic sealing surfaces.

A valve construction which can effect a primary seal by engagement of metallic surfaces, yet protect such metallic surfaces against erosion through the utilization of a nonresilient, nonelastometric secondary sealing element which effects or maintains a minimal contact between the valve seat and the valve head during the final closing or the initial opening movements of the valve head, would be highly desirable.

SUMMARY OF THE INVENTION

This invention provides a valve for use in a high-temperature, high-pressure environment comprising an annular metallic valve seat assembly defining an annular primary sealing surface on one end face. A secondary seal comprising a ring of nonelastomeric, nonmetallic sealing material is mounted in surrounding relationship to the primary sealing surface and is axially shiftable relative to the primary sealing surface. Resilient means are provided for normally biasing the secondary seal ring axially to a position where a portion of the secondary seal ring extends axially beyond the primary sealing surface.

A valving head is then movable into engagement with the valve seat assembly, and the valve head has an annular metallic sealing surface. The outer edge of the annular metallic sealing surface initially establishes a peripheral line contact with the nonresilient secondary seal ring to establish a seal sufficient to prevent high-velocity flow of abrasive particles past the metallic sealing surfaces. Then further movement of the valve head toward its closed position axially shifts the secondary seal ring relative to the primary sealing surface on the metallic seat assembly and permits the full metal-to-metal engagement of the primary sealing surface with the annular metallic sealing surface on the valve head. In this position, the nonresilient, nonmetallic sealing element is also compressed to assume a position of sealing engagement with the outer annular portions of the annular metallic sealing surface on the valve head.

Thus, both in the opening and the closing motions of the valve head relative the valve seat assembly, the metallic sealing surfaces are protected from the erosion effects of high-velocity abrasive particles due to the fact that the nonmetallic, nonresilient seal element closes prior to full sealing engagement between the metallic sealing surfaces and also opens subsequent to the separation of the metallic sealing surfaces so that whatever high-velocity fluid jets are produced in either the valve-opening or the valve-closing motions, are produced primarily between the nonmetallic, nonresilient sealing element and the outer periphery of the valve head.

Further advantages of the invention will be readily apparent to those skilled in the art of the following detailed description, taken in conjunction with the annexed sheet of drawings, on which is shown a preferred embodiment of the invention.

BRIEF DESCRIPTIONS OF THE DRAWINGS

DESCRIPTION OF THE EMBODIMENT

Figure 1:
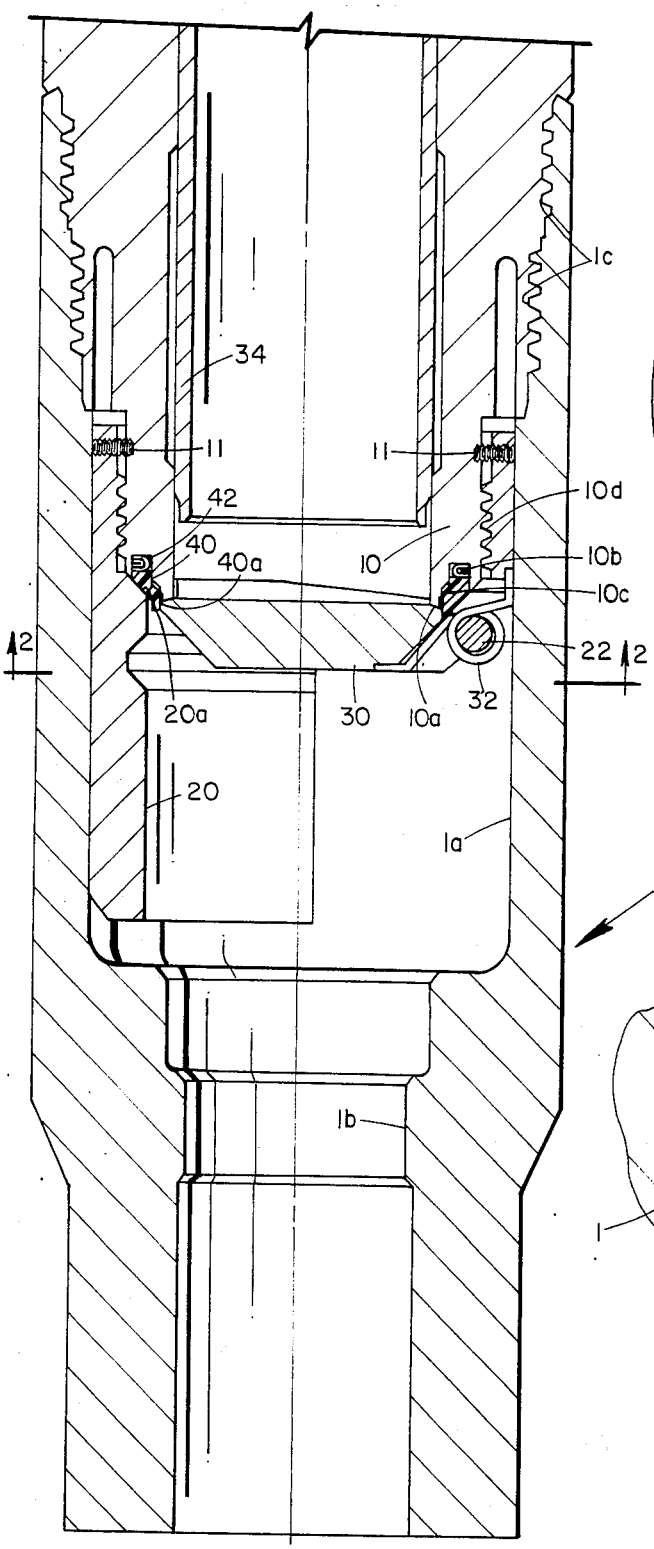
FIG. 1 is a vertical sectional view of a flapper valve having a sealing system embodying this invention and shown in its installed and closed position in a well conduit.
Figure 2:
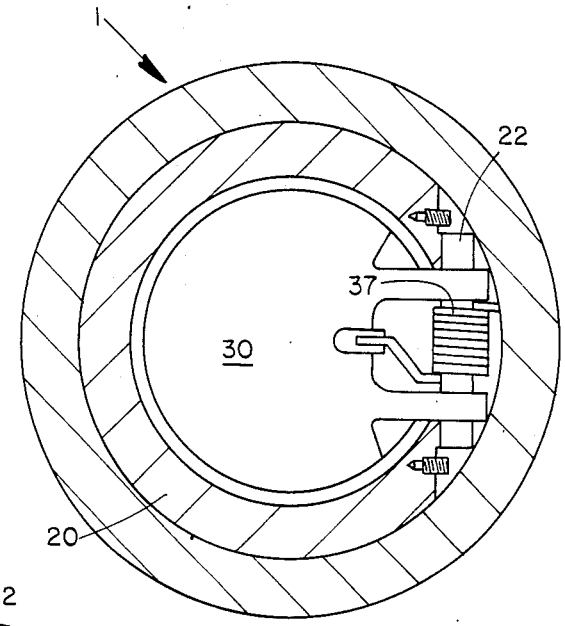
FIG. 2 is a sectional view taken on the plane 2—2 of FIG. 1.

Referring to the drawings, a valve housing 1 suitable for incorporation in a well tubing string defines a large-diameter cylindrical chamber 1*a* communicating at its lower end with smaller-diameter bore 1*b*. Internal threads 1*c* are provided at the upper end of housing 1 for engagement with cooperating threads provided on a valve seat sub 10. Valve seat sub 10 is provided with external threads 10*d* at its lower end for engagement with a flapper valve mounting housing 20. Set screws 11 secure this threaded connection.

A transverse pin 22 is supported by the flapper valve mounting housing 20 in conventional fashion and a flapper 30 is pivotally mounted on such pin 22 and is resiliently urged to a horizontal closed position by a torsion spring 32.

Figure 3:
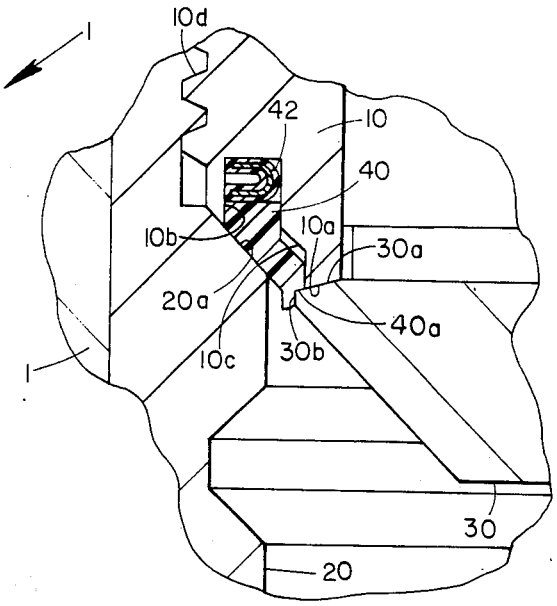
FIG. 3 is an enlarged-scale, partial view of a portion of the sealing elements utilized in FIG. 1.

The flapper valve 30 is of conventional configuration and is fabricated with an arcuate cross section so as to lie outside of the path of the fluids passing through the bore of the valve housing 10 when flapper valve 30 is in its open vertical position (not shown). As best shown in FIG. 3, the top end of the flapper valve 30 is provided with an annular metallic sealing surface 30*a* adjacent to its periphery which is disposed at an angle of approximately 15 degrees with respect to the horizontal. A correspondingly shaped primary annular sealing surface 10*a* is provided on the extreme lower end of the valve seat sub 10. The engagement of annular metallic surfaces 10*a* and 30*a* provide the primary seal for the valve 1.

Immediately adjacent the metallic sealing, primary sealing surface 10*a*, an annular recess 10*b* is formed in the bottom face of the valve seat sub 10. The inner wall of the recess 10*b* is provided with an inclined surface 1O*c* disposed at an angle substantially greater than the angle of the annular sealing surface 30*a* on the flapper valve 30, preferably on the order of 30 to 45 degrees.

The remainder of the recess 10*b* has parallel cylindrical inner and outer walls.

A secondary seal ring 40 is mounted in recess 10*b* for axially shiftable movement. Seal ring 40 is preferably formed from a nonresilient organic material such as a fluorocarbon marketed under the trademark "Teflon". This material is sufficiently resistant to the temperatures encountered in the well environment to maintain its integrity, but it does not have any substantial degree of resilience. To impart a resilient force to the nonresilient seal ring 40, an annular spring unit 42 is mounted between the base of the recess 10*b* and exerts a downward force on the nonresilient seal element 40. Spring element 42 preferably comprises a metal spring 42*a* of U-shaped cross section which is coated with a fluorocarbon marketed under the trademark "Teflon". Of course, the spring 42*a* could be integrally incorporated in the nonresilient seal element 40, if desired.

The nonresilient seal element 40 is retained in the annular slot 10*b* by an inclined, upwardly facing shoulder 20*a* formed on the flapper mounting sleeve 20. It will be noted that the axial spring force exerted on the nonelastomeric seal ring 40 will also cause a radially inwardly compression of the nonresilient seal ring 40 by inclined shoulder 20*a*.

In the operation of the sealing system for a downhole well valve heretofore described, the flapper valve 30 is released to move to its closed position under the bias of the torsion spring 32 by upward movement of a conventional sleeve-type actuator 34. As flapper valve moves toward its closed position, the outer perimeter of the annular sealing surface 30*a* provided on the flapper valve first makes a line contact with the lowermost angular edge 40*a* of the nonresilient seal element 40. This line contact is sufficient to prevent the high-velocity passage of abrasive particles through the narrowing gap between the metallic sealing surface 30 on the flapper valve 30 and the primary metallic sealing surface 10*a* on the valve seat 10. Since the force exerted by the torsion spring 32 is substantially greater than that exerted by the annular spring 42, the nonresilient seal element 40 is forced axially into the recessed 10*b*, permitting the primary metallic sealing surface 30*a* on the flapper valve 30 to engage the primary sealing surface 10*a* on valve seat 10. Concurrently, the nonresilient seal element 40 is sealably engaged with the outer perimeter portions of the primary sealing surface 30*a* on flapper valve 30.

As the fluid pressure builds up beneath the flapper valve 30, a completely reliable metallic seal is established between the sealing annular sealing surface 30*a* on flapper valve 30 and the primary metallic sealing surface 10*a* on the valve seat 10.

In the opening movement of the flapper valve, a similar desirable effect is produced in as much as the breaking of the seal between the two metallic sealing surfaces 10*a* and 30*a* does not effect the concurrent opening of the seal between the flapper valve 30 and the nonresilient sealing element 40. Thus, the final breakage of the seal is accomplished by moving the flapper valve 30 out of contact with the tip end 40*a* of the nonresilient seal 40, and the possibilities of erosion of the primary metallic sealing surfaces is therefore substantially reduced.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patents is:

1. A downhole valve for selectively opening and closing fluid flow through a well conduit subject to high-temperature, high-pressure environmental conditions comprising: an annular metallic valve seat assembly fixedly mounted in said conduit; said valve seat assembly defining an annular primary sealing surface on one end face; a secondary seal comprising a ring of nonelastomeric, nonmetallic sealing material; means for mounting said secondary seal ring on said valve seat body in surrounding relation to said primary sealing surface and for limited axial displacement relative to said valve seat assembly; resilient means urging said secondary seal ring axially to a position where a portion of said secondary seal ring extends axially beyond said primary sealing surface; a metallic valve head mounted for movement into sealing engagement with said valve seat assembly; said valve head having an annular sealing surface initially contacting said secondary seal ring to establish a seal and to axially shift said secondary seal ring relative to said primary sealing surface and compress said secondary seal ring; said annular sealing surface on said valve head subsequently engaging said primary sealing surface to complete the sealing engagement with said valve seat assembly.

2. The valve of claim 1 wherein said secondary seal ring is fabricated from a fluorocarbon material.

3. The valve of claim 1 wherein said resilient means comprises a ring of flexible metal having a U-shaped cross section.

4. The valve of claim 3 wherein said flexible metal ring is embedded in a fluorocarbon material.

5. The valve of claim 1 wherein said valve head comprises a pivotally mounted flapper element.

* * * * *